US006859200B2

(12) United States Patent
Park et al.

(10) Patent No.: US 6,859,200 B2
(45) Date of Patent: Feb. 22, 2005

(54) DISPLAY APPARATUS AND CONTROL METHOD

(75) Inventors: Kwon-Yop Park, Suwon (KR); Ho-Woong Kang, Yongin (KR)

(73) Assignee: Samsung Electronics, Co., Ltd., Suwon-si (KR)

( * ) Notice: Subject to any disclaimer, the term of this patent is extended or adjusted under 35 U.S.C. 154(b) by 459 days.

(21) Appl. No.: 09/983,814

(22) Filed: Oct. 26, 2001

(65) Prior Publication Data

US 2002/0080128 A1 Jun. 27, 2002

(30) Foreign Application Priority Data

Dec. 27, 2000 (KR) ..... 2000-83359

(51) Int. Cl.[7] ..... G09G 5/00
(52) U.S. Cl. ..... 345/204
(58) Field of Search ..... 345/74, 75, 204, 345/904, 156, 1.2, 3.4, 110, 364, 157, 172, 132, 173, 508, 112, 12, 3, 20; 257/59; 348/687

(56) References Cited

U.S. PATENT DOCUMENTS 5,440,339 A 8/1995 Harrison et al.
5,581,788 A 12/1996 Ballare
5,910,806 A * 6/1999 Narui et al. ..... 345/536
5,940,052 A * 8/1999 Xia et al. ..... 345/74.1
5,943,029 A 8/1999 Ross
5,945,793 A * 8/1999 Park et al. ..... 315/411
5,956,022 A 9/1999 Cheng
6,151,016 A * 11/2000 Kanbe et al. ..... 345/204
6,211,533 B1 * 4/2001 Byun et al. ..... 257/59
6,320,626 B1 * 11/2001 Lee ..... 348/687
6,373,476 B1 * 4/2002 Dalgleish et al. ..... 345/204
6,565,192 B1 * 5/2003 Vinals et al. ..... 347/41
2001/0011980 A1 * 8/2001 Jang ..... 345/87

FOREIGN PATENT DOCUMENTS

| | | |
|---|---|---|
| JP | 9-128330 | 5/1997 |
| JP | 10-011039 | 1/1998 |
| JP | 11-015457 | 1/1999 |
| KR | 1996-003375 | 1/1996 |
| KR | 1998-004756 | 3/1998 |
| KR | 1998-075417 | 11/1998 |
| KR | 2000-0002552 | 1/2000 |
| KR | 2000-0027144 | 5/2000 |

* cited by examiner

*Primary Examiner*—Vijay Shankar
*Assistant Examiner*—Prabodh M. Dharia
(74) *Attorney, Agent, or Firm*—Robert E. Bushnell, Esq.

(57) ABSTRACT

The present invention relates to a display apparatus and a control method, which comprises a monitor displaying a picture by receiving a video signal according to a display data channel standard. The present invention is comprised of microcomputer including a voltage detector detecting a voltage level of said video signal, wherein the microcomputer determines whether or not the detected voltage level is beyond a predetermined allowable limit and controls the display apparatus to display an indication of an abnormality of the video signal if the detected voltage level is beyond the predetermined allowable limit. With this configuration, a display apparatus and a method for controlling the same, which can determine whether or not the voltage level input from a video card is abnormal, by detecting the voltage level of the video signal, and solve a unstable output generated from the video signal having the abnormal voltage level signal.

13 Claims, 4 Drawing Sheets

DISPLAY APPARATUS AND CONTROL METHOD

CLAIM OF PRIORITY

This application makes reference to, incorporates the same herein, and claims all benefits accruing under 35 U.S.C §119 from an application entitled Display Apparatus And Control Method earlier filed in the Korean Industrial Property Office on Dec. 27, 2000, and there duly assigned Ser. No. 2000-83359 by that Office.

1. Field of the Invention

The present invention relates in general to a display apparatus and a control method thereof, and more particularly, a display apparatus and a control method which can determine whether or not video signals are abnormal.

2. Description of the Related Art

Generally, a video adapter, i.e., a graphics card or video card, is provided in a computer for supplying a video signal to a microcomputer in a monitor. Because of the lack of communication between the computer and the display, a display data channel (DDC) standard was developed to enable the host computer and the display to communicate. Descriptions of the various DDC standards are available from the Video Electronics Standards Association (VESA) located in San Jose, Calif.

The DDC standard provides basic configuration information of the display to the host computer. In response to the Plug and Play needs by end-users, VESA has defined the DDC standard, made of different levels of communication. In a first alternative, referred to as DDC1, DDC data is continuously transmitted from the display to the host system.

In a second alternative, referred to as DDC2, or DDC2Bi, DDC2B+ and DDC2AB, bi-directional communication between the computer graphic host and the display device is enabled. This standard describes and compares each display control interface. In this second alternative, data is only transmitted from the display device to the host computer when the host computer requests the data, and the DDC data is clocked by a DDC clock signal which is provided by the host computer via a signal path which was unused and undefined for previous display system connections.

Bi-directional communication between a monitor and a video card allows the monitor to continuously send an Extended Display Identification (EDID) message to the video card. The EDID specifies the following: screen resolutions supported (and refresh rates for each); screen dot-pitch and the monitor's bandwidth; power-conservation capabilities (that is, DPMS support); and product information, such as the model number (to help match the video driver software to the adapter and monitor). This enables the video card to automatically select the highest resolution supported by a monitor and prevent users from selecting unsupported modes.

The monitor can also be controlled (for example, setting the refresh rate, resolution, color temperatures, screen position, brightness, and contrast), through the use of easier-to-use standard PC utilities, rather than monitor-specific utilities or front-panel push-buttons.

FIG. 4 is a block diagram showing a control of a conventional microcomputer 120 and a video card 110 in detail. As depicted therein, the microcomputer 120 is provided with a display data channel (DDC) function in order to transmit and receive data between the monitor and the video card of a computer (not shown). The monitor supports both the DDC1 and the DDC2 standards. The DDC1 function transmits information continuously when the vertical synchronous signal is input, and the DDC2 function transmits information at request.

However, in the conventional display apparatus, because the transmission is unconditionally performed without considering a DDC data line and a DDC clock line, it is difficult to determine whether the monitor is functioning abnormally or the video card is functioning abnormally, when a plug & play function is not performed. Thus, though the video card may be functioning abnormally, a user may mistakenly request that the monitor be repaired, and consequently the abnormality is not repaired promptly and accurately.

Additionally, in the video card operated in a non-standard specification through the DDC data line, namely, in the abnormal video card, if the DDC data line is converted to "low" in order to transmit and receive between the computer and the monitor, a ground level becomes unstable, thereby causing the problem of an unstable display on the monitor.

SUMMARY OF THE INVENTION

Accordingly, the present invention has been made in view of the above-described shortcomings, and it is an object of the present invention to provide a display apparatus and a method for controlling the same, which allow an output of the monitor to be stable by detecting the voltage of a video signal.

This and other objects of the present invention may be achieved by a provision of a display apparatus comprising a monitor displaying a picture by receiving the video signal, further a microcomputer comprising a voltage detector detecting a voltage level of the video signal; the microcomputer determining whether or not the voltage level detected by the voltage detector is beyond a predetermined allowable limit, and indicating that the video card is functioning abnormally when the detected voltage level is beyond the allowable limit.

Preferably, the microcomputer is further comprised of a voltage controller adjusting the voltage level so that the detected voltage level is under the allowable limit.

The microcomputer is compatible with a DDC1 standard and a DDC2 standard for data transmission between a computer and the monitor, and if the detected voltage is beyond the allowable limit, the data is transmitted according to the DDC2 standard, so that the display of the monitor is stable.

Additionally, a method for controlling a display apparatus comprising a monitor displaying a picture by receiving a video signal, comprises the steps of detecting a voltage level of the video signal; determining whether or not the detected voltage level of the video signal is beyond a predetermined allowable limit; and indicating abnormality of the video signal if it is determined that the detected voltage level is beyond the allowable limit.

Effectively, the step of detecting the voltage level of the video signal comprises the steps of adjusting the voltage level so that the detected voltage level is under the allowable limit; and detecting the adjusted voltage level.

The display apparatus is capable of using both the DDC1 standard and the DDC2 standard for data transmission between the computer and the monitor, and the video card supports both standards. And in the step of indicating abnormality of the video signal, the video signal is transmitted according to the DDC2 standard if the voltage level is beyond the allowable limit, thereby allowing the display of the monitor to be stable.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
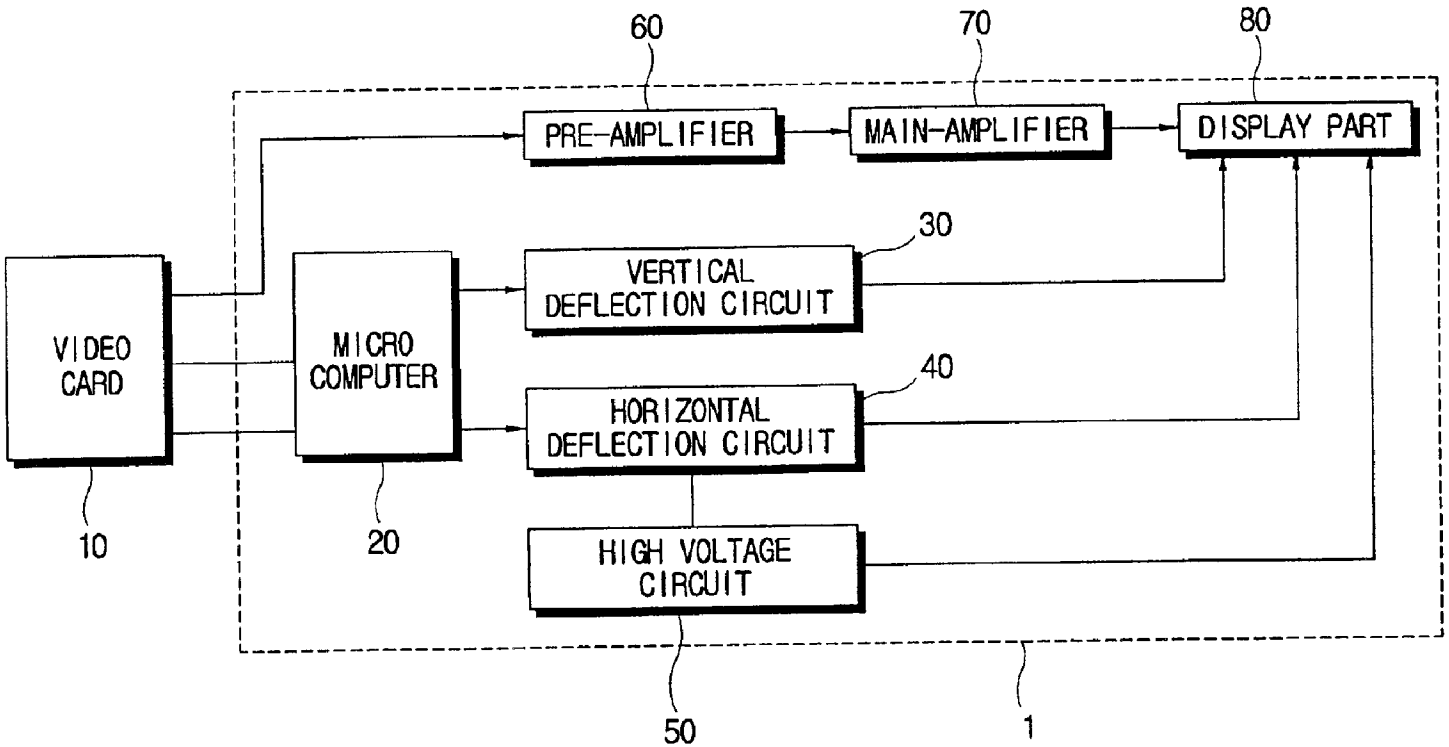
FIG. 1 is a schematic diagram showing a configuration of a display apparatus according to the principles of the present invention.

Referring to FIG. 1, a display apparatus according to the present invention is comprised of a video card 10 provided in a computer (not shown) and supports both the DDC1 standard and the DDC2 standard for supplying a video signal to a monitor 1. The monitor is comprised of a microcomputer 20 that generates a control signal for controlling a screen after receiving the video signal from the video card 10, and a display part 80 displaying a picture according to the control signal from the microcomputer 20. The monitor 1 is further comprised of a vertical deflection circuit 30 and a horizontal deflection circuit 40 deflecting the video signal, a high voltage circuit 50 supplying a high voltage to an anode (not shown) of the monitor 1 by using a pulse from the horizontal deflection circuit 40, a pre-amplifier 60 and a main-amplifier 70 for amplifying the video signal from the video card 10.

Figure 2:
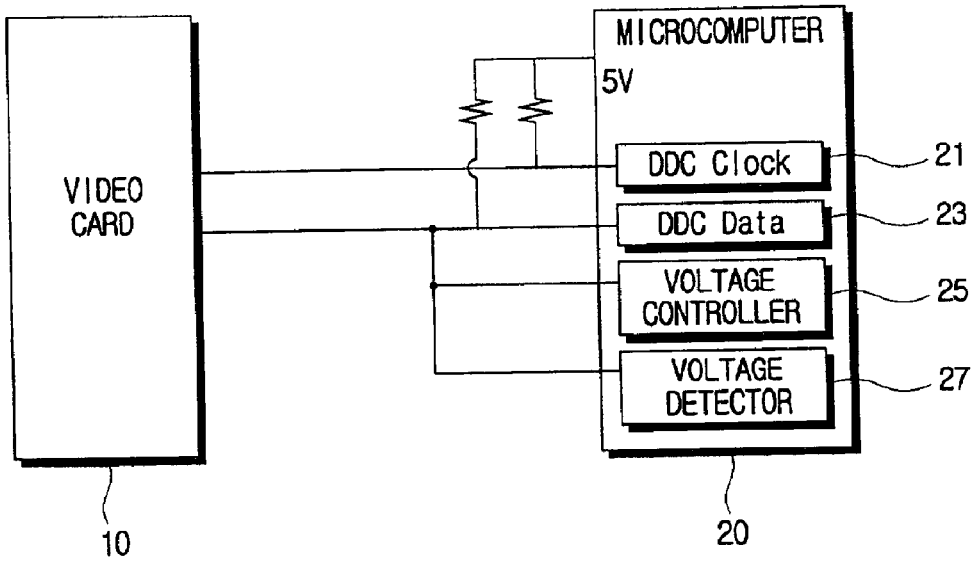
FIG. 2 is a block diagram showing a control of a microcomputer and a video card in detail according to the present invention.

Referring to FIG. 2, the microcomputer 20 is provided with a display data channel (DDC) function in order to mutually transmit and receive data between the monitor 1 and video card 10. Even if a user does not know the specification information of the monitor 1, the DDC allows the monitor 1 to display a picture thereon by transmitting an EDID message containing the monitors specifics to the video card 10.

The DDC function supports both the DDC1 standard and the DDC2 standard, wherein the DDC1 standard requires the transmission of information continuously in response to the vertical synchronous signal output from the video card 10, and the DDC2 standard requires that the video card request the information before it is transmitted.

In the microcomputer 20, having the DDC function, are provided a DDC clock line 21 supplying a signal periodically in order to receive data, and a DDC data line 23 transmitting data. Further provided are a voltage controller 25 adjusting a voltage level applied from the video card 10 to a lower voltage level with a predetermined value, and a voltage detector 27 detecting the voltage level adjusted by the voltage controller 25.

The microcomputer 20 detects the voltage level of the video signal adjusted by the voltage controller 25. The microcomputer 20 determines whether or not the detected voltage level is beyond a predetermined allowable limit, and indicates that the video card 10 is functioning abnormally when the detected voltage level is beyond the allowable limit. The voltage controller 25 may add a certain value to the voltage level of the video signal, or remove a certain value from the voltage level of the video signal in order to adjust the voltage level. In other words, it is desired that the voltage controller 25 adjust the voltage level of the DDC data line to a predetermined level, e.g., 0 volts (the ground level of the microcomputer 20), and then voltage detector 27 determines whether reduced voltage level is within a predetermined allowable limit of the predetermined level, e.g., less than or equal to 0.7 volts.

In addition, the microcomputer 20 normally transmits data between the video card 10 and the monitor 1 using the DDC1 standard, and, if the detected voltage level is beyond the allowable limit, changes from the DDC1 standard to the DDC2 standard.

Figure 3:
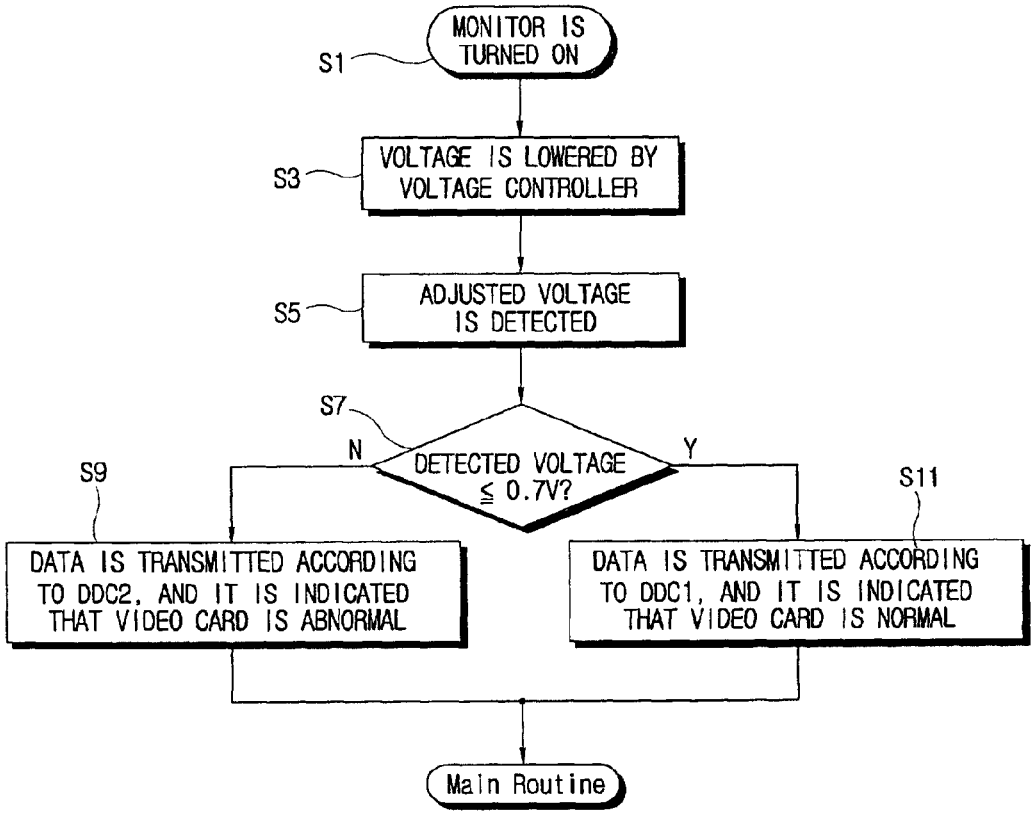
FIG. 3 is a control flow chart according to the present invention.
Figure 4:
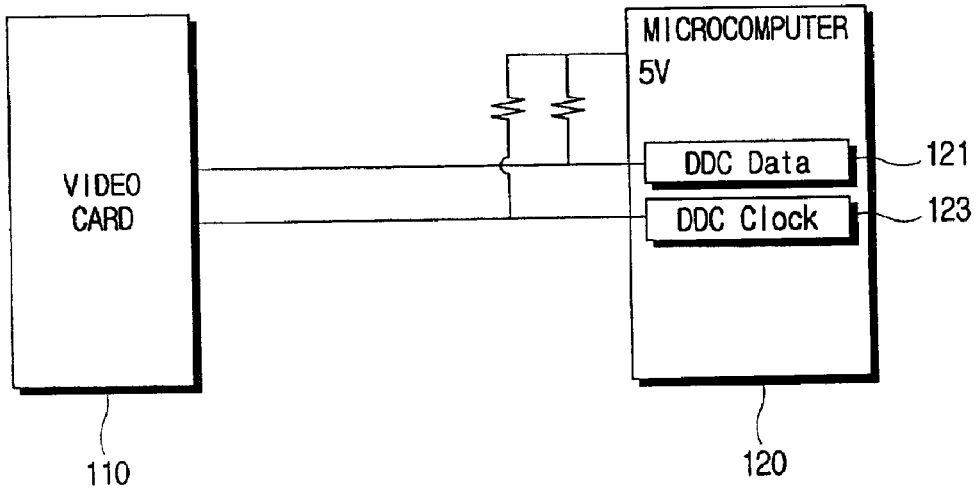
FIG. 4 (PRIOR ART)
FIG. 4 is a block diagram showing a control of a conventional microcomputer and a video card in detail.

FIG. 3 is a control flow chart illustrating the preferred control method according to the present invention. As shown therein, the monitor is turned on (step S1). Before performing the DDC function, the voltage level of the video signal input through the DDC data line 23 is lowered by a predetermined amount by the voltage controller 25 (S3). After lowering the voltage level of the video signal, the resulting voltage level is detected by the voltage detector 27 (S5).

Whether or not the detected voltage level is within a predetermined allowable limit (below a reference voltage level) of the predetermined level, is determined (S7). If the detected voltage level is within the predetermined allowable limit, a data transmission between the video card 10 and the monitor 1 is performed according to the DDC1 standard. At this time, it is indicated that the video card 10 is functioning normally (S11). However, if the detected voltage level is beyond the predetermined allowable limit, the DDC standard is changed to the DDC2 standard, and it is indicated that the video card 10 is functioning abnormally (i.e., an unstable ground level of microcomputer 20) (S9). The normality or abnormality may be indicated visually on display part 80 or aurally.

In the step S7, for example, the microcomputer 20 determines whether or not the detected voltage level is below 0.7V by means of the voltage detector 27 thereof. Where the detected voltage level is equal to or less than 0.7V, the video card 10 is determined to be operating normally, so that a data line is initiated so as to transmit data according to the DDC1 standard. On the other hand, where the detected voltage level is greater than 0.7V, the video card 10 is determined to be operating abnormally, so that data is transmitted after converting to the DDC2 standard. If the data transmission method is converted to the DDC2 standard, an indication of the abnormal operation of video card 10 is displayed on the display part 80 of the monitor 1.

With this configuration, if the voltage detector 27 and the voltage controller 25 are utilized according to the present invention, it is possible to determine whether the video card uses the standard specification (5V, 3.3 mA) or a different specification (3.3V, 8 mA). Therefore, when the data is transmitted continuously according to the DDC1 standard, lowering of the DDC data line and inflow of the large current are protected, and the ground level of the microcomputer 20 is prevented from becoming unstable. That is, since the DDC1 communication is continuous, the ground level of the microcomputer 20 could become unstable and result in an abnormal picture on the monitor, however, the present invention the microcomputer 20 detects an abnormal operation and suspends the DDC1 communication by switching to the DDC2 standard.

As described above, the display apparatus and the method for controlling the same according to the present invention, which determines abnormality or normality of the video card by means of the detected voltage level of the video signal, and solves an unstable display owing to an abnormal voltage level signal.

What is claimed is:

1. A display apparatus comprising a monitor displaying a picture by receiving a video signal, further comprising:

a voltage detector detecting a voltage level of the video signal; and a microcomputer determining whether or not the voltage level detected by the voltage detector is beyond a predetermined allowable limit, and indicating abnormality of a video card when the detected voltage level is beyond the allowable limit.

2. The display apparatus according to claim 1, wherein the microcomputer is further comprised of a voltage controller adjusting the voltage level so that the detected voltage level is under t he allowable limit.

3. The display apparatus according to claim 1, wherein the microcomputer uses a DDC1 Display Data Channel) standard and a DDC2 standard for data transmission between a computer and the monitor, and, if the detected voltage level is beyond the allowable limit, the data is transmitted according to the DDC2 standard.

4. The display apparatus according to claim 2, wherein the microcomputer uses a DDC1 (Display Data Channel) standard and a DDC2 standard for data transmission between a computer and the monitor, and, if the detected voltage level is beyond the allowable limit, the data is transmitted according to the DDC2 standard.

5. A method for controlling a display apparatus comprising a monitor displaying a picture by receiving a video signal, comprising the steps of:

detecting a voltage level of the video signal;

determining whether or not the detected voltage level of the video signal is beyond a predetermined allowable limit; and indicating abnormality of the video signal if it is determined that the detected voltage level is beyond the allowable limit.

6. The method according to claim 5, wherein the step of detecting the video signal comprises the steps of:

adjusting the voltage level of the video signal by a predetermined amount; and detecting the adjusted voltage level.

7. The method according to claim 5, wherein the display apparatus uses a DDC1 (Display Data Channel) standard and a DDC2 standard for data transmission between a computer and the monitor, and, if the detected voltage level is beyond the allowable limit, the data is transmitted according to the DDC2 standard.

8. The method according to claim 6, wherein the display apparatus uses a DDC1 (Display Data Channel) standard and a DDC2 standard for data transmission between a computer and the monitor, and, if the detected adjusted voltage level is beyond the allowable limit, the data is transmitted according to the DDC2 standard.

9. A microcomputer in a monitor displaying a picture in response to a received video signal transmitted from a video card of a computer according to a display data channel (DDC) standard, said microcomputer comprising:

a voltage controller adjusting the voltage level of a video signal transmitted by the video card according to a DDC1 standard; and a voltage detector detecting the adjusted voltage level;

said microcomputer determining whether or not the voltage level detected by the voltage detector is beyond a predetermined allowable limit, and changing to a DDC2 standard when the detected voltage level is beyond the allowable limit.

10. The microcomputer as set forth in claim 9, wherein said voltage controller adjusts the voltage level by reducing the voltage level by a predetermined amount.

11. The microcomputer as set forth in claim 10, wherein said voltage controller attempts to adjust the voltage level to a ground level of said microcomputer by reducing the voltage level by said predetermined amount.

12. The microcomputer as set forth in claim 11, changing to said DDC2 standard when the detected voltage level is determined to be greater than 0.7 volts.

13. The microcomputer as set forth in claim 12, controlling said monitor to display an indication normality or abnormality of the video signal, the abnormality being indicated when the detected voltage level is determined to be greater than 0.7 volts.

* * * * *